US009004595B1

(12) United States Patent
Larrieu

(10) Patent No.: US 9,004,595 B1
(45) Date of Patent: Apr. 14, 2015

(54) SPINAL SUPPORT DEVICE

(71) Applicant: Peter Larrieu, Corona Del Mar, CA (US)

(72) Inventor: Peter Larrieu, Corona Del Mar, CA (US)

( * ) Notice: Subject to any disclaimer, the term of this patent is extended or adjusted under 35 U.S.C. 154(b) by 33 days.

(21) Appl. No.: 13/712,966

(22) Filed: Dec. 12, 2012

Related U.S. Application Data

(60) Provisional application No. 61/569,694, filed on Dec. 12, 2011.

(51) Int. Cl.
*A47C 7/42* (2006.01)
*A47C 7/14* (2006.01)
*A47C 7/40* (2006.01)

(52) U.S. Cl.
CPC ..... *A47C 7/40* (2013.01)

(58) Field of Classification Search
CPC ..... A47C 7/425; A47C 7/46
USPC ..... 297/230.1, 230.13, 284.5, 284.1, 284.6, 297/230.11
See application file for complete search history.

(56) References Cited

U.S. PATENT DOCUMENTS

| | | | | | |
|---|---|---|---|---|---|
| 4,097,087 | A * | 6/1978 | Garavaglia | 297/230.14 X |
| 4,108,492 | A * | 8/1978 | Kirby | 297/284.6 X |
| 4,862,536 | A * | 9/1989 | Pruit | 297/284.5 |
| 4,876,755 | A * | 10/1989 | Parrish | 297/284.5 X |
| 5,054,854 | A * | 10/1991 | Pruit | 297/284.6 X |
| 5,303,977 | A * | 4/1994 | Sereboff | 297/284.5 X |
| 5,344,211 | A * | 9/1994 | Adat et al. | 297/284.5 X |
| 5,624,158 | A * | 4/1997 | Adat et al. | 297/230.14 |
| 5,863,095 | A * | 1/1999 | Rivard et al. | 297/230.13 |
| 6,795,990 | B1 * | 9/2004 | Hutchinson | 5/632 |
| 6,969,114 | B2 * | 11/2005 | Keilhauer | 297/230.1 |
| 7,703,849 | B2 * | 4/2010 | Bilak et al. | 297/284.6 |
| D639,961 | S * | 6/2011 | Gomez et al. | D24/188 |
| 8,414,514 | B2 * | 4/2013 | Gomez et al. | 602/36 |
| 8,435,201 | B2 * | 5/2013 | Gomez et al. | 602/33 |
| 8,449,486 | B2 * | 5/2013 | Gomez et al. | 602/36 |
| 2008/0066233 | A1 * | 3/2008 | Russell | 5/632 |
| 2008/0150337 | A1 * | 6/2008 | Bilak et al. | 297/230.1 |
| 2008/0277985 | A1 * | 11/2008 | Petzel | 297/284.6 |

* cited by examiner

*Primary Examiner* — Rodney B White
(74) *Attorney, Agent, or Firm* — Kafantaris Law Offices; Theo Kafantaris

(57) ABSTRACT

The present disclosure will provide a simple spinal support device that can be used while sitting to force the user to develop proper posture and reduce back strain. This is accomplished by creating a 'T' shaped device that can be ergonomically designed for the back. The user will place the device against the back rest of a chair prior to sitting. Alternatively, the device will be integrated within the chair. When in use, the spinal support member will force the user's shoulders to go backwards, improving his or her posture instantly.

8 Claims, 15 Drawing Sheets

SPINAL SUPPORT DEVICE

CROSS-REFERENCE TO RELATED APPLICATIONS

This application claims the benefit of U.S. Provisional Patent Application No. 61/569,694, filed on Dec. 12, 2011, and incorporated herein by reference.

STATEMENT REGARDING FEDERALLY SPONSORED RESEARCH AND DEVELOPMENT

Not Applicable.

FIELD OF THE INVENTION

This invention relates to a spinal support device, and more particularly, to a device that can support the back and spine of the user and encourage proper posture.

DISCUSSION OF RELATED ART

Posture is the position in which a person holds their body upright while sitting, standing or laying down. Proper posture is achieved when the body is the least strained by the force of gravity or when the muscles and ligaments are properly supported. Without maintaining proper posture, the back muscles can become strained and develop complications. Back support devices allow the bones and joints to maintain the correct alignment in order to prevent the muscles from experiencing injuries.

Back rests and seat cushion supports are generally shaped to fit the curvature of the user's back to promote proper form and back support. They typically cover the lower part of the chair, or lumbar area, and provide little other additional support. Like other back supports, they are intended to promote a comfortable and proper form to the user's back.

Cushioned back support devices are similar to small pillows and generally used to support the lower back of the user. They are typically placed behind the lower back and they are positioned against the back of a chair. As the users sit, the curvature of the cushioned back support allows them to rest their lower back and improve the spine's posture or to promote a neutral posture.

Lumbar support belts or back belts are normally lightweight belts positioned around the lower back to provide support to the spine or lumbar. Back belts force the users to stiffen their spine to reduce pressure in the spinal cord. They are typically from leather or plastic and they can prevent injuries from occurring when lifting heavy objects.

While several devices for maintaining proper posture exist in the prior art, they are often limited in their benefit to the user, and typically include unnecessary and costly features. Therefore, a need exists for a simple spinal support device that can be used while sitting to force the user to develop proper posture and reduce back strain. The present invention satisfies these needs.

SUMMARY OF THE INVENTION

The present invention will provide a simple spinal support device that can be used while sitting to force the user to develop proper posture and reduce back strain. This is accomplished by creating a 'T' shaped device that can be ergonomically designed for the back. The user will place the device against the back rest of a chair prior to sitting. Alternatively, the device will be integrated within the chair. When in use, the spinal support member will force the user's shoulders to go backwards, improving his or her posture instantly.

The spinal support device comprises a spinal support member attached perpendicular to a lumbar support member, creating the aforementioned 'T' shape. Each support member is cylindrical in nature, although several ergonomic shapes are anticipated for each member to better support the back of the user. The support members are made of inflatable vinyl with separate air chambers. When inflated, the user can adjust the air pressure to their individual preference. Alternatively, the device can be made of vinyl-covered foam, or another set of materials involving a firm inner core surrounded by a soft outer shell to provide cushioning.

Optional sleeves will be available to consumers who wish to personalize the present invention, allowing them to slide a colored, patterned, or textured material over the support members. In each of these embodiments, the present invention is attached to the chair with an attaching strap that loops around the spinal support member and then fastens around the chair back. Alternatively, the device can be directly and permanently installed within a chair and purchased as a single unit, eliminating the need for an exterior attaching strap. The end result will be a simple device which provides the user both lumbar and spinal support on any desired chair without incorporating unnecessary or extravagant features.

These and other objectives of the present invention will become obvious to those of ordinary skill in the art after reading the following detailed description of the preferred embodiments. It is to be understood that the foregoing general description and the following detailed description are exemplary, and are intended to provide further explanation of the invention as claimed.

DETAILED DESCRIPTION OF THE PREFERRED EMBODIMENT

Figure 1:
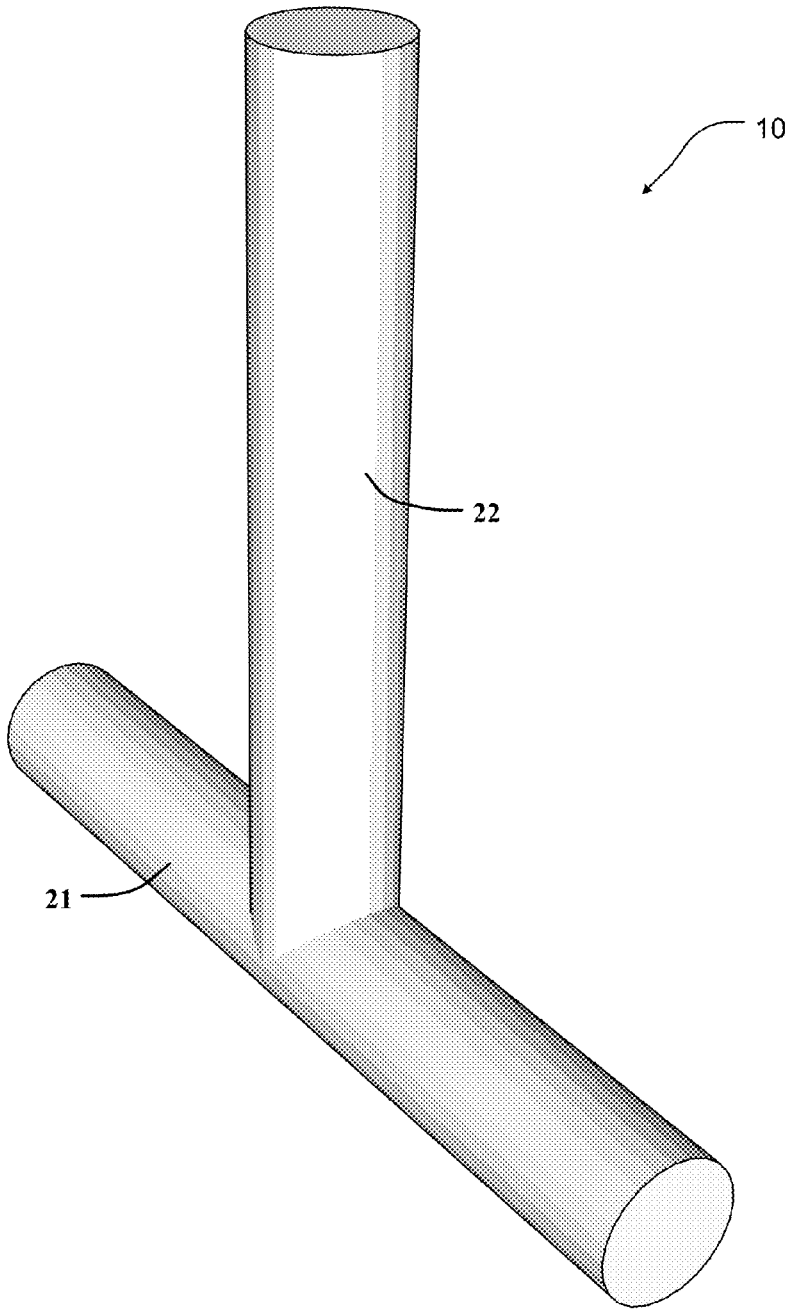
FIG. 1 is a front isometric view of the invention.
Figure 2:
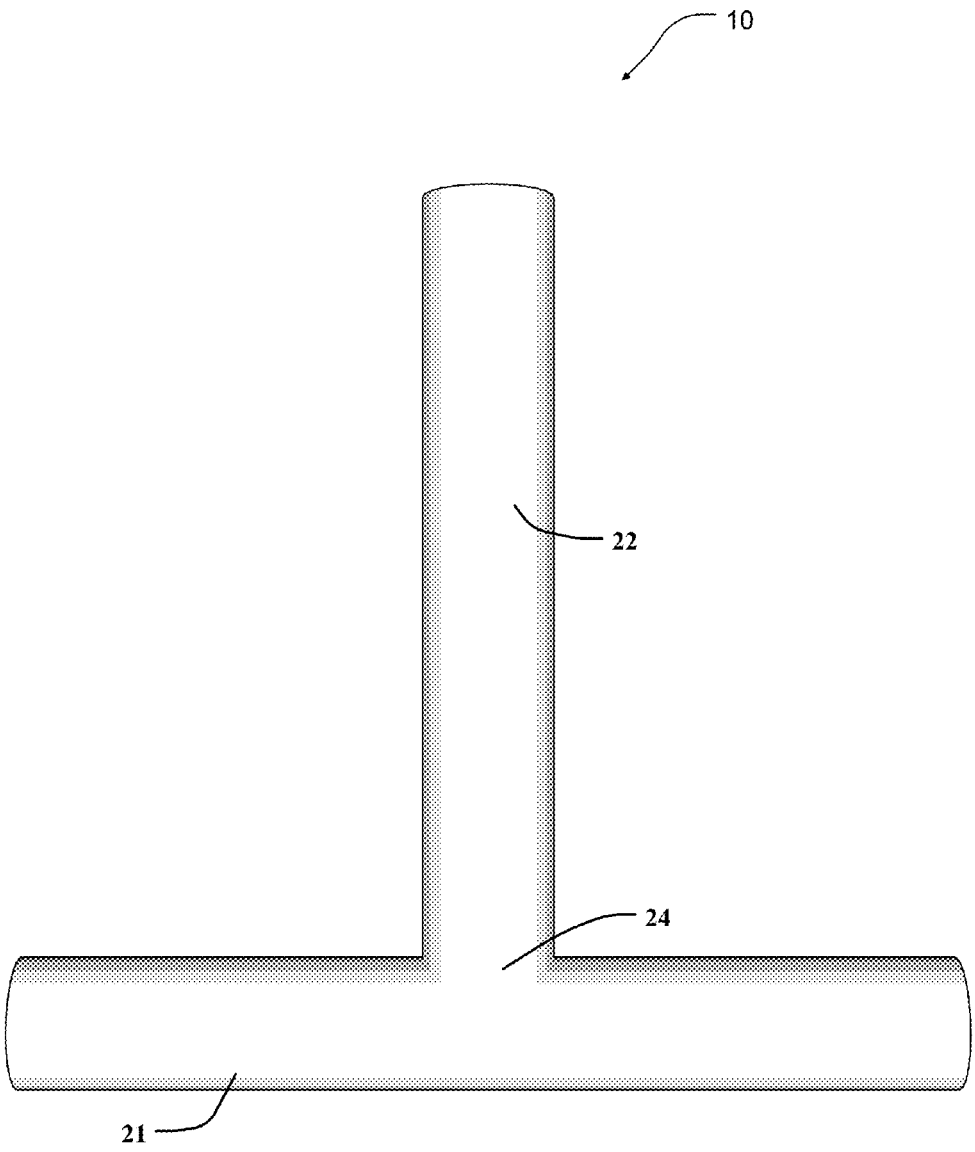
FIG. 2 is a front view of the invention.
Figure 3:
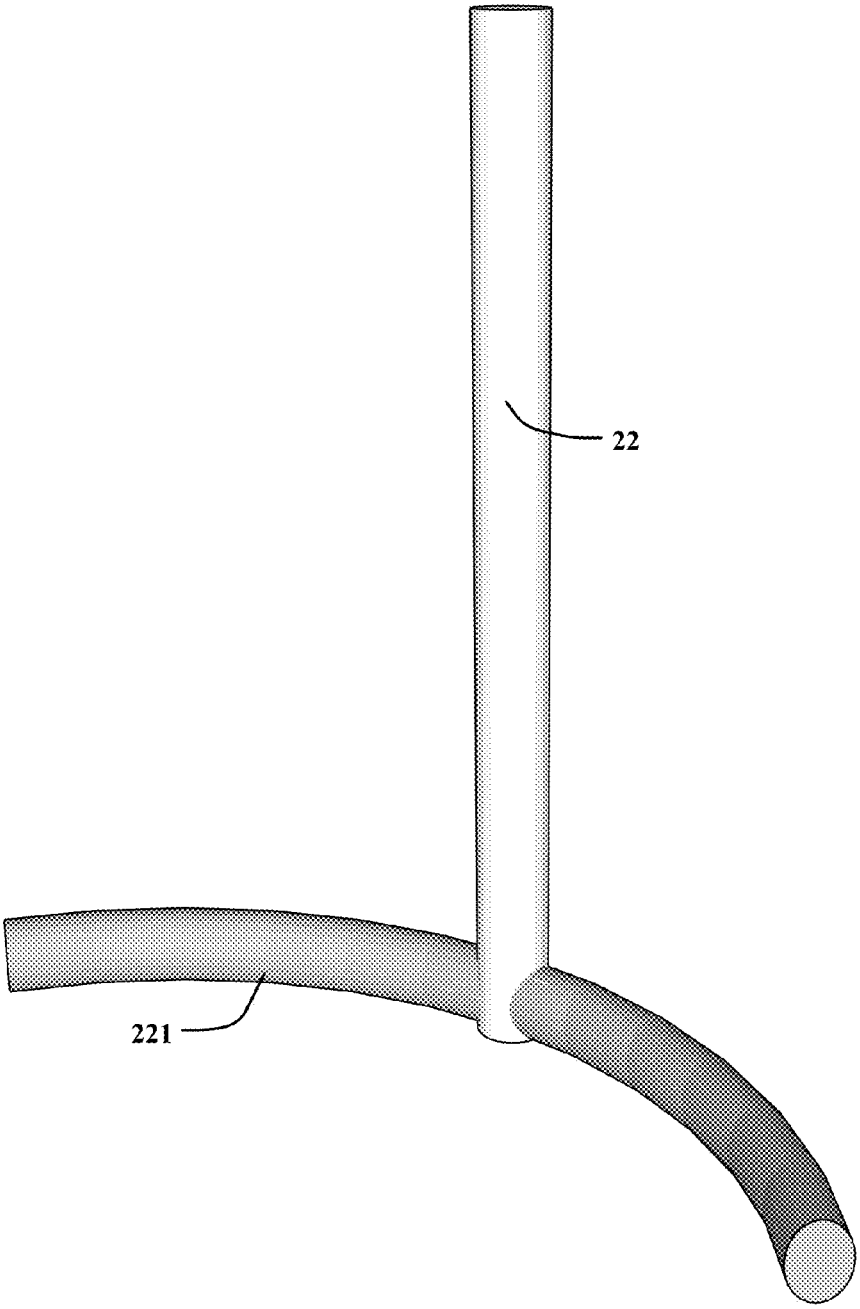
FIG. 3 is a front isometric view of the invention.
Figure 4:
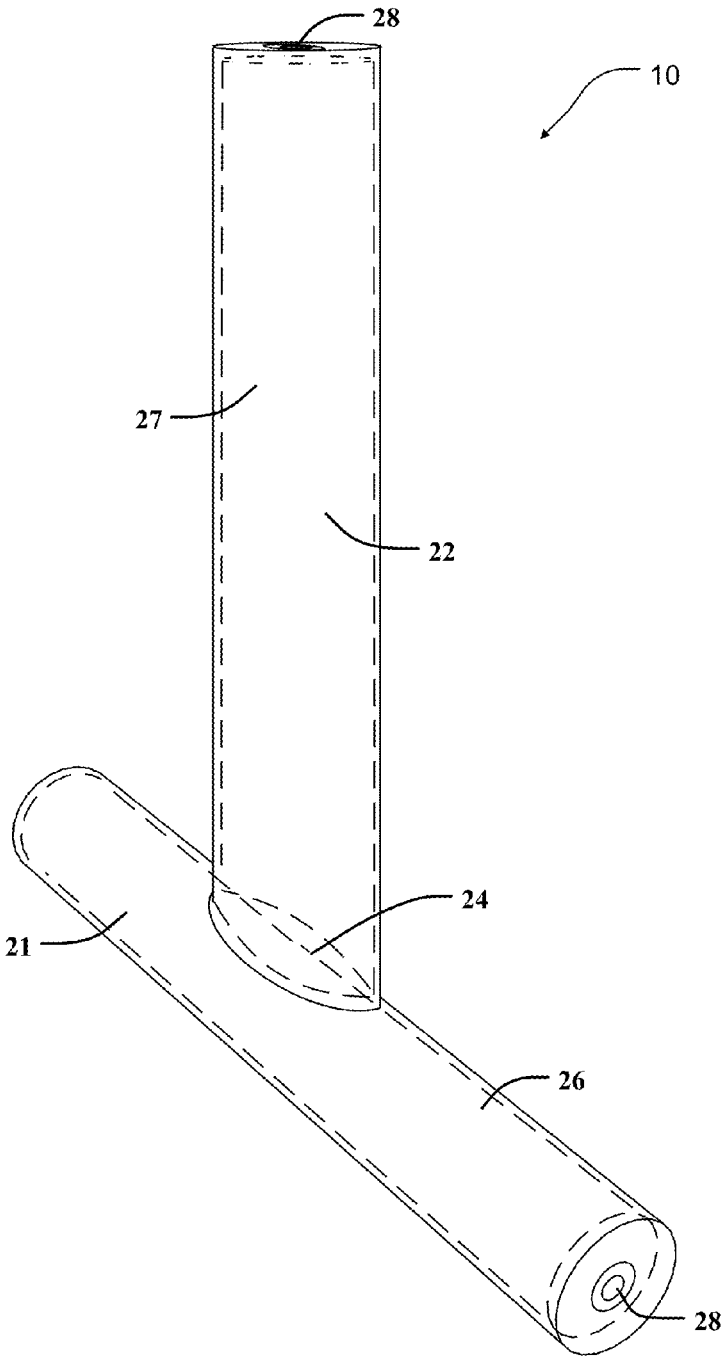
FIG. 4 is a front isometric view of the invention.
Figure 5:
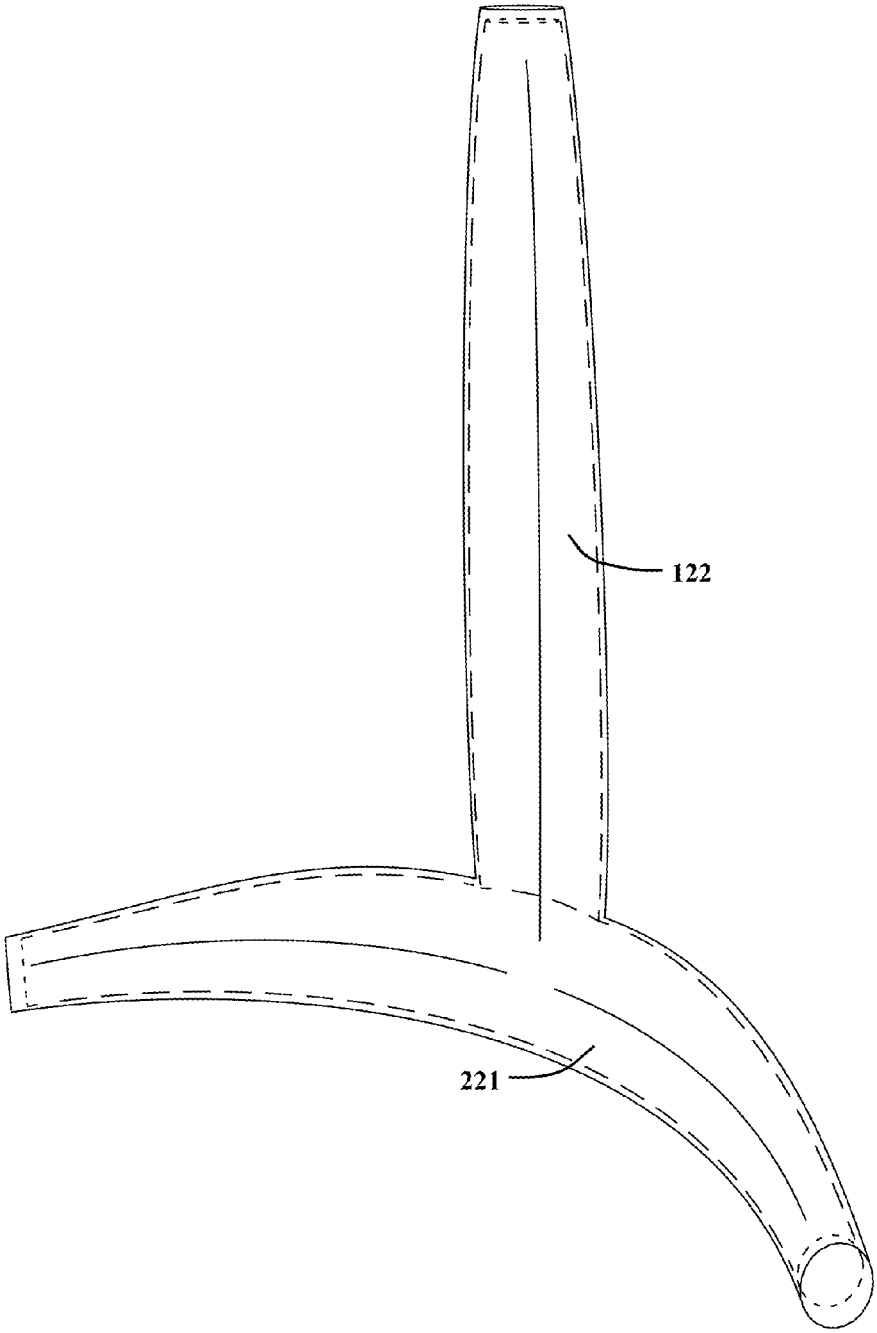
FIG. 5 is a front isometric view of the invention.
Figure 6:
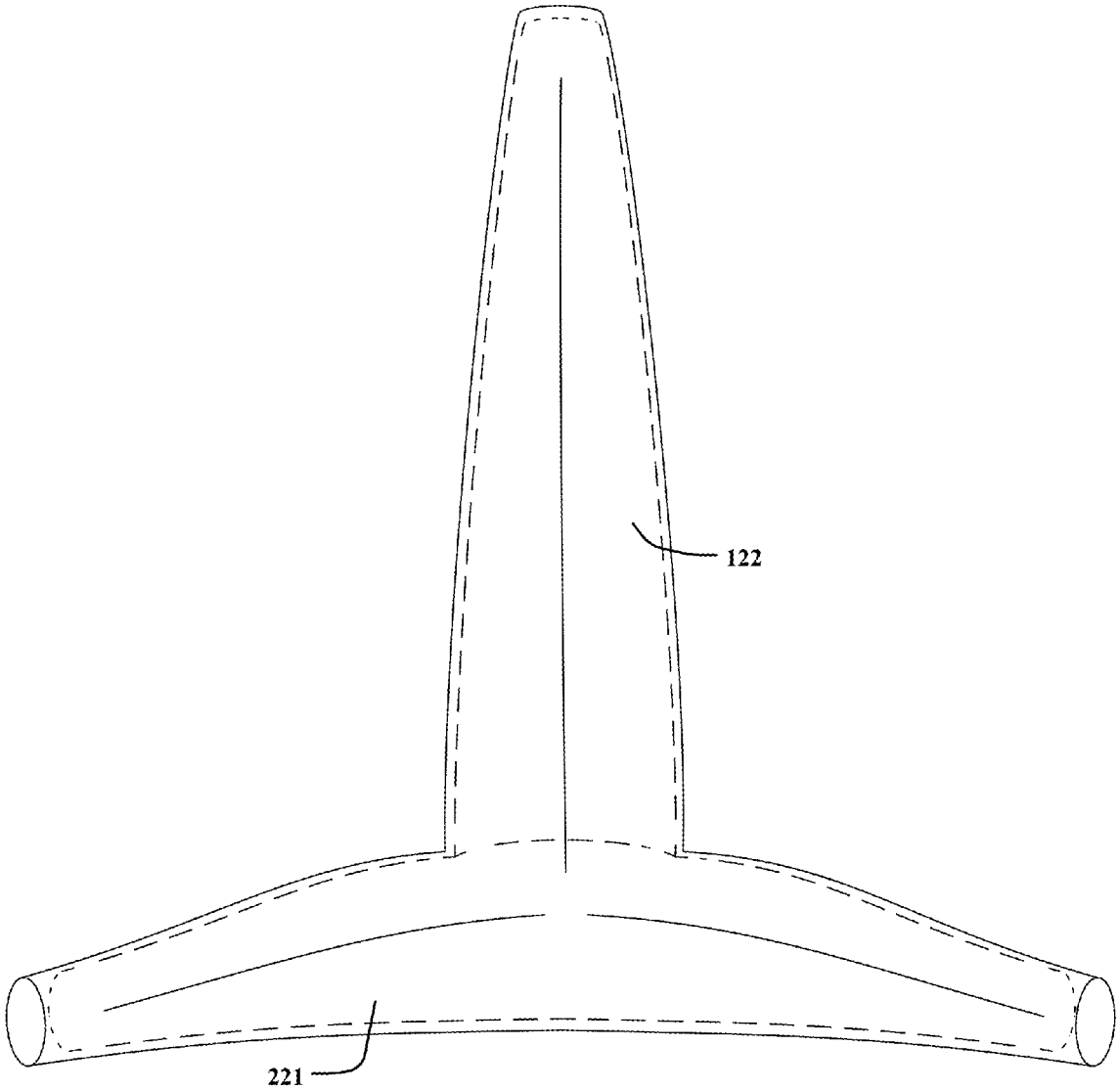
FIG. 6 is a front view of the invention.
Figure 7:
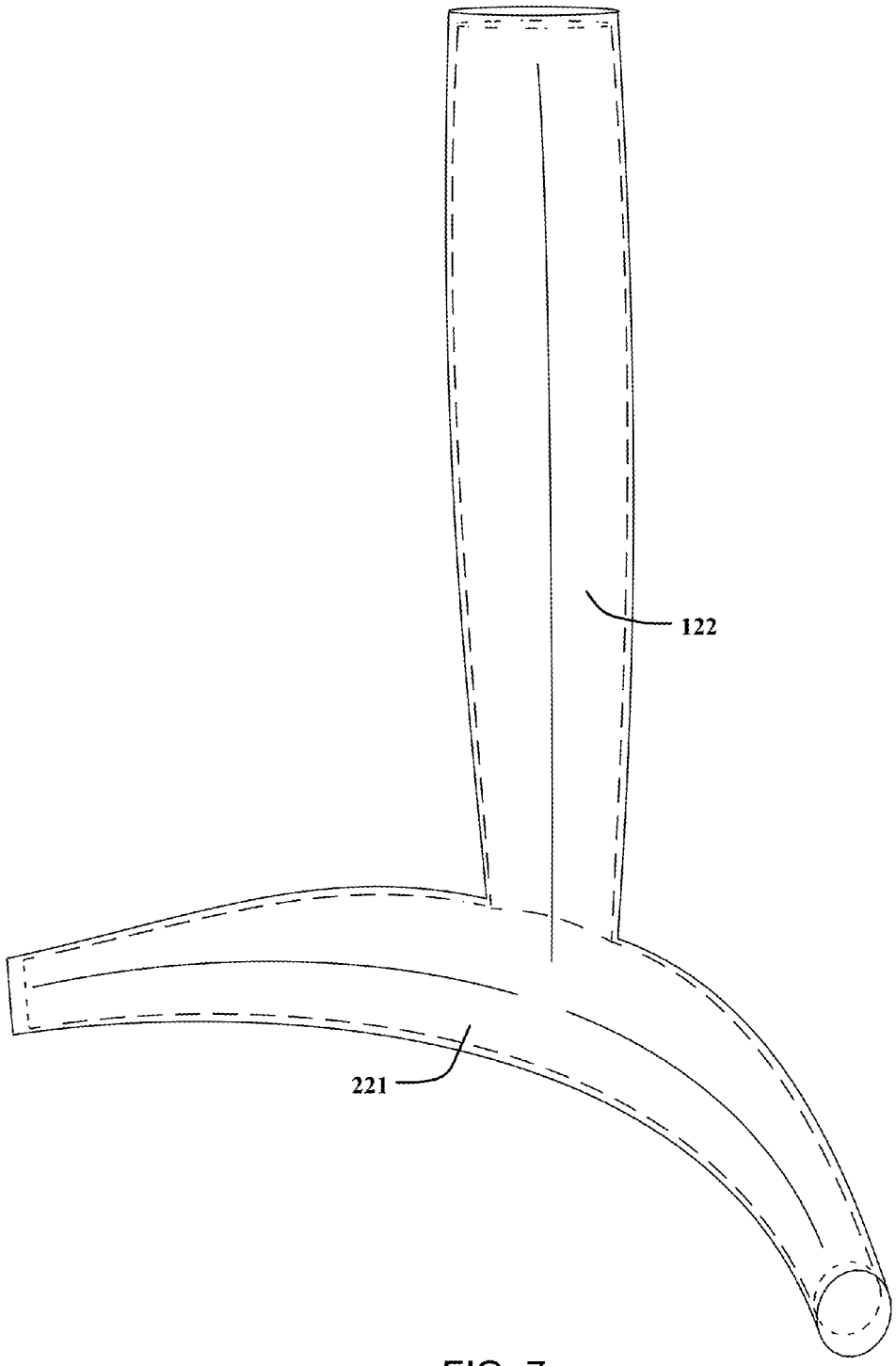
FIG. 7 is a front isometric view of the invention.
Figure 8:
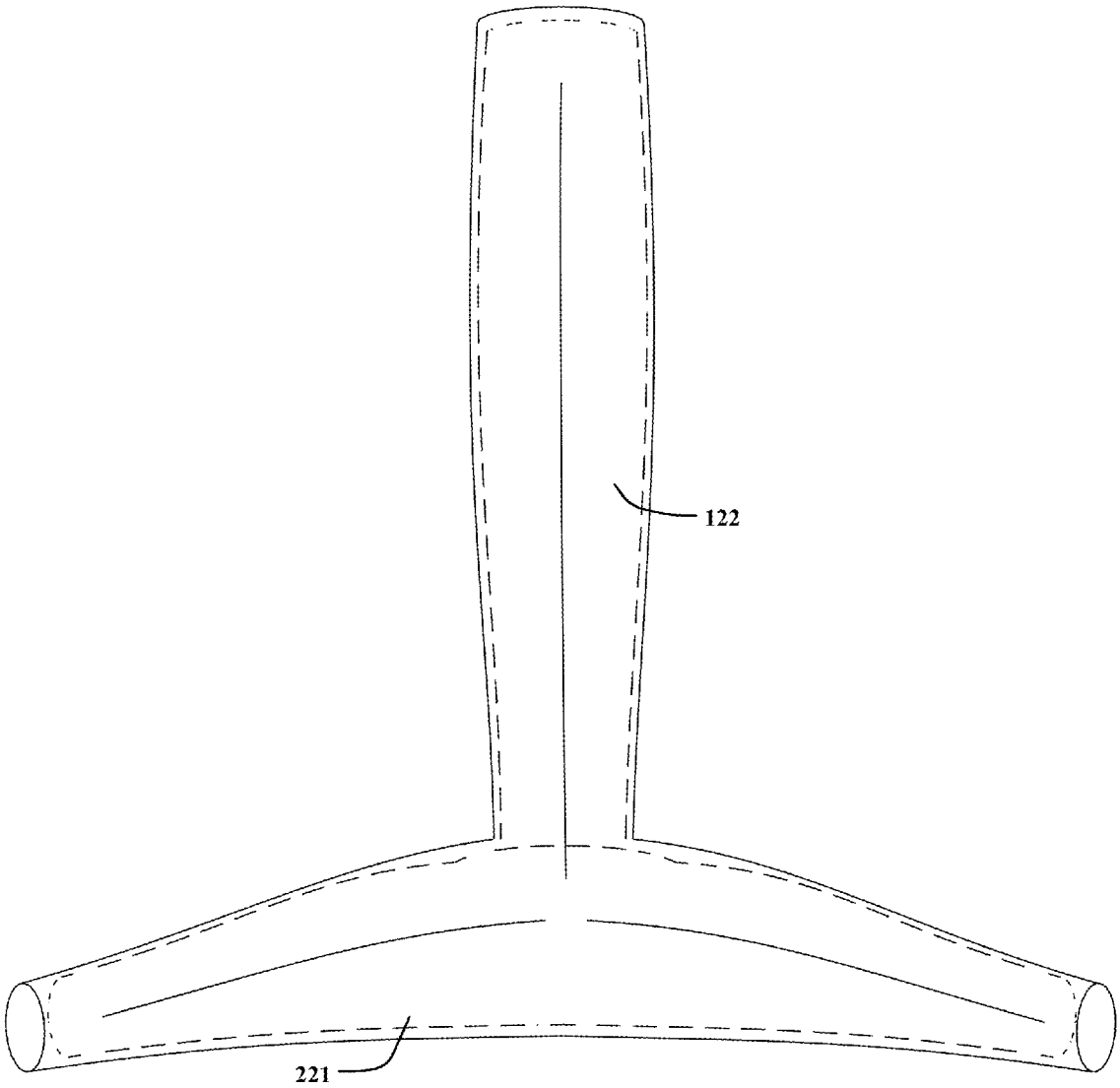
FIG. 8 is a front view of the invention.
Figure 9:
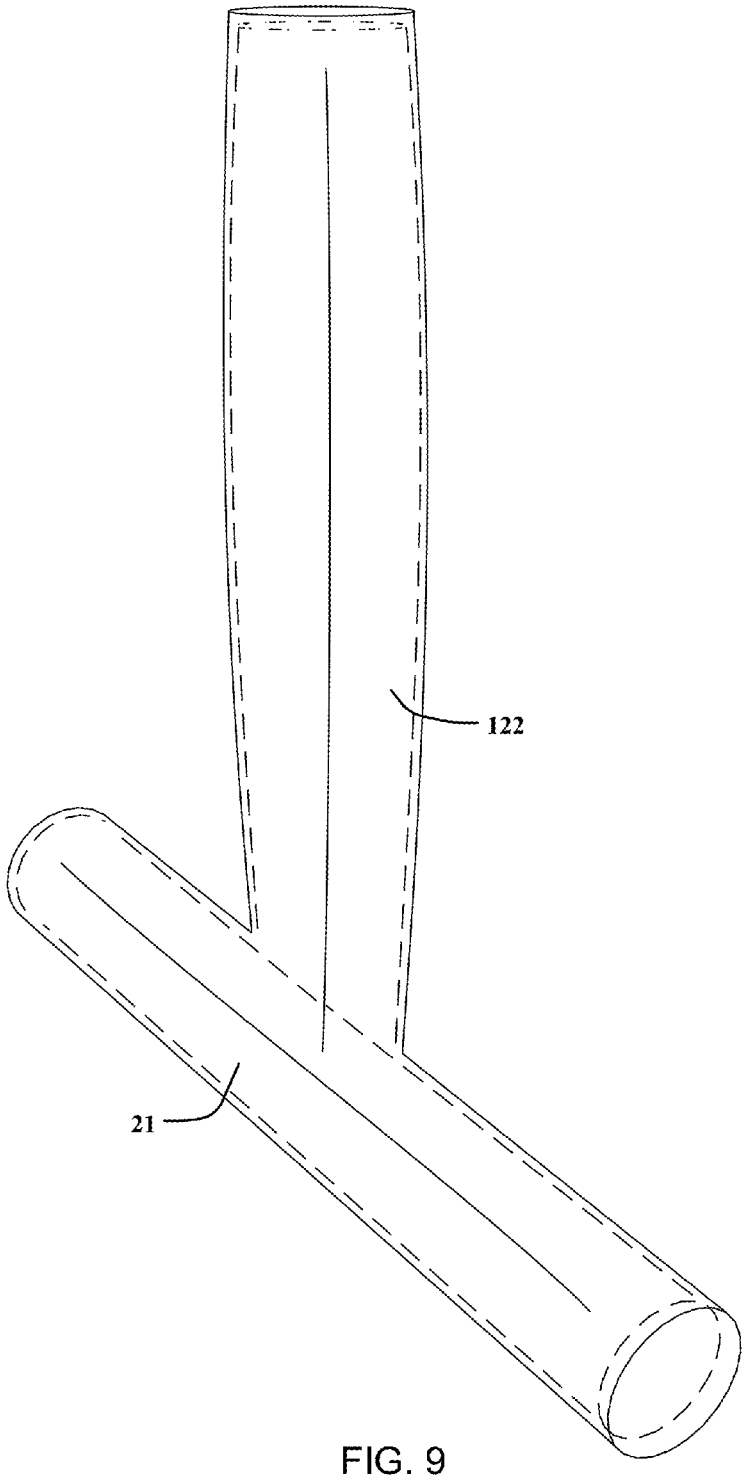
FIG. 9 is a front isometric view of the invention.
Figure 10:
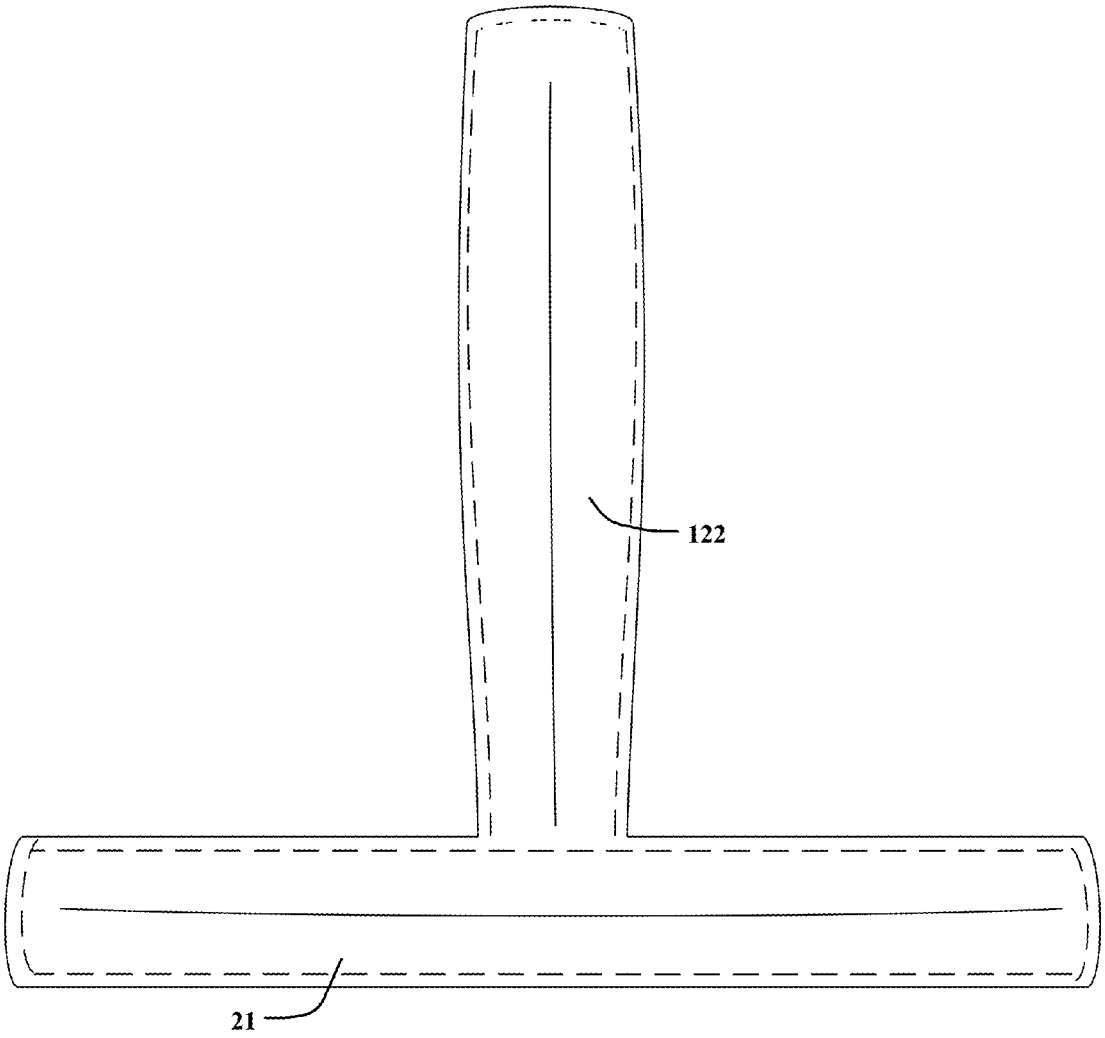
FIG. 10 is a front view of the invention.
Figure 11:
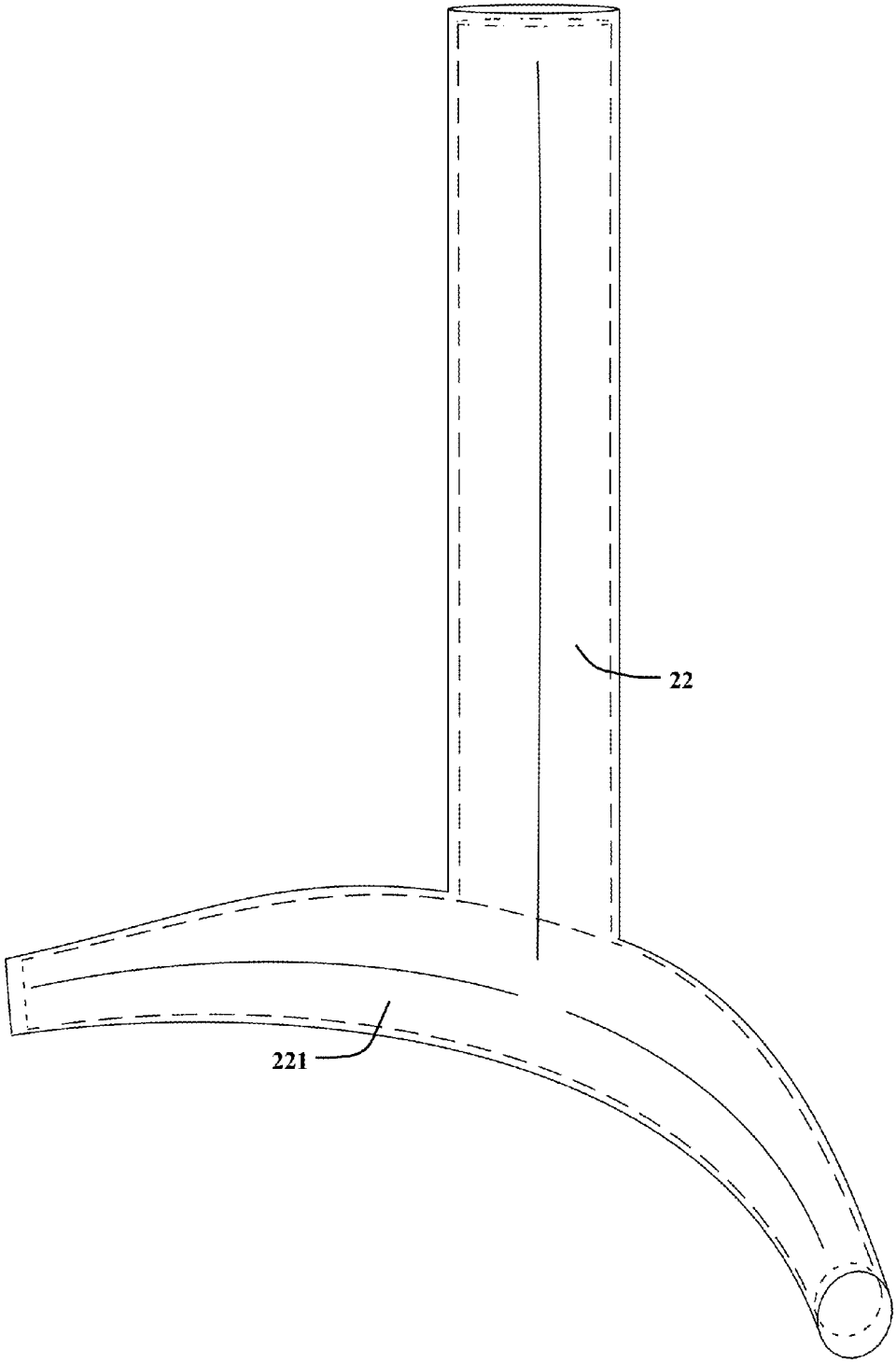
FIG. 11 is a front isometric view of the invention.
Figure 12:
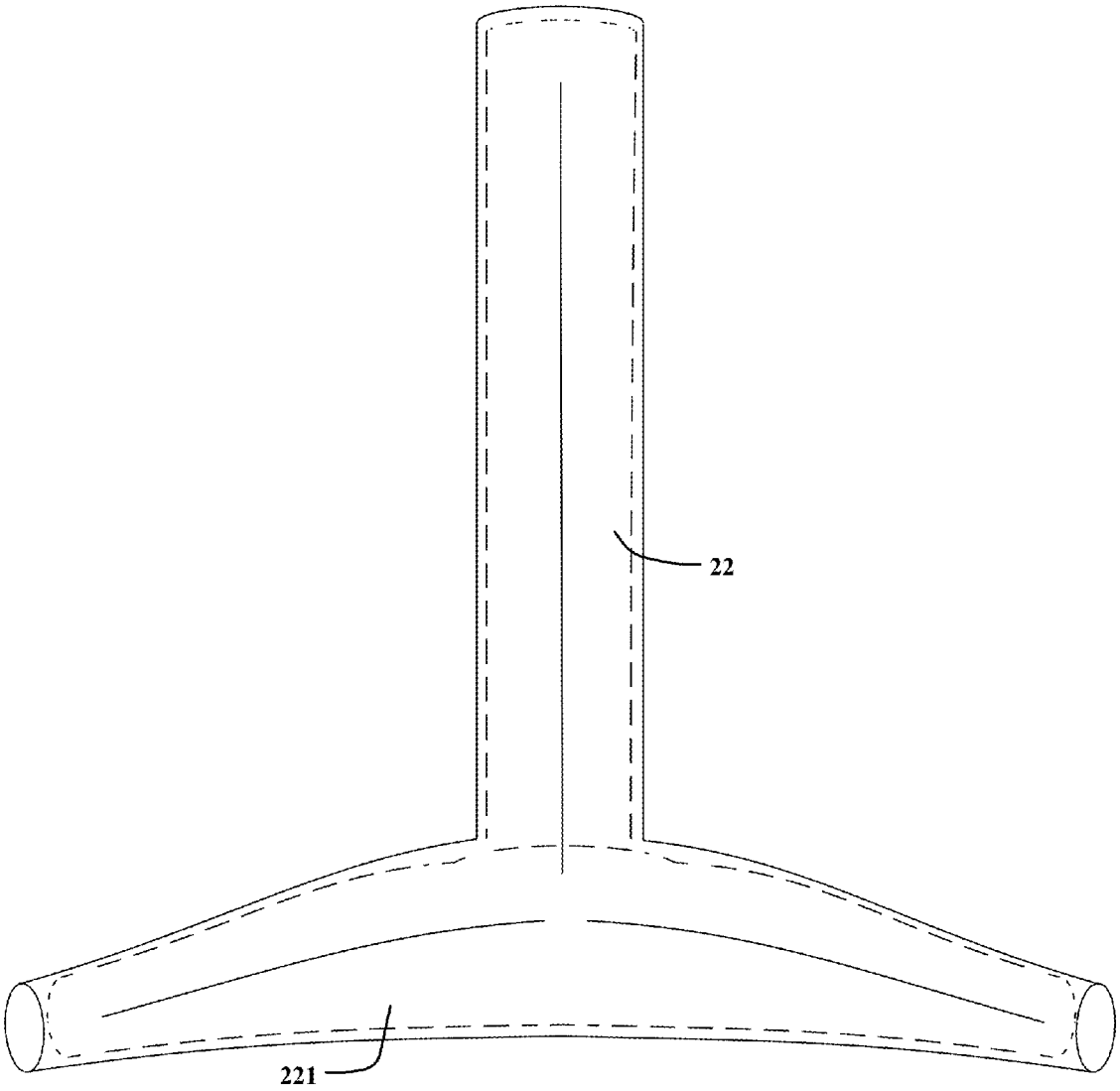
FIG. 12 is a front view of the invention.
Figure 13:
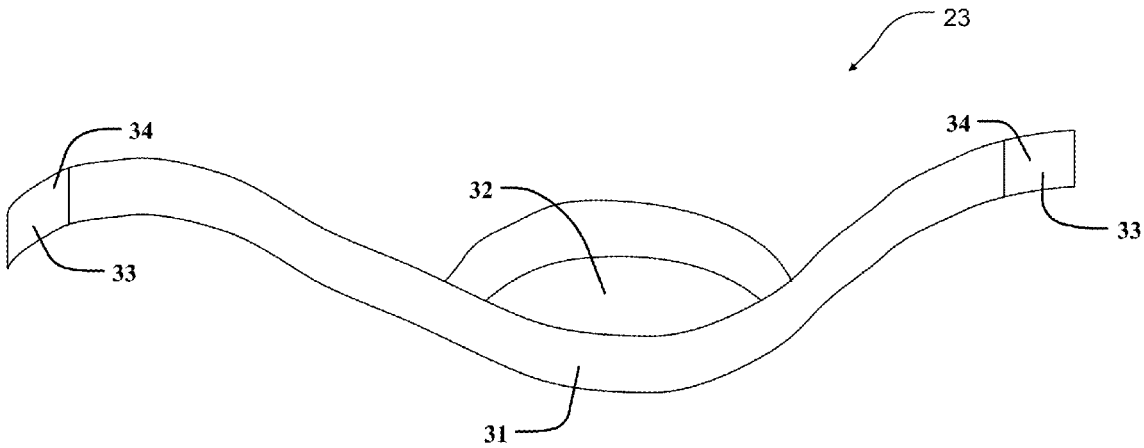
FIG. 13 is a front view of the strap.
Figure 14:
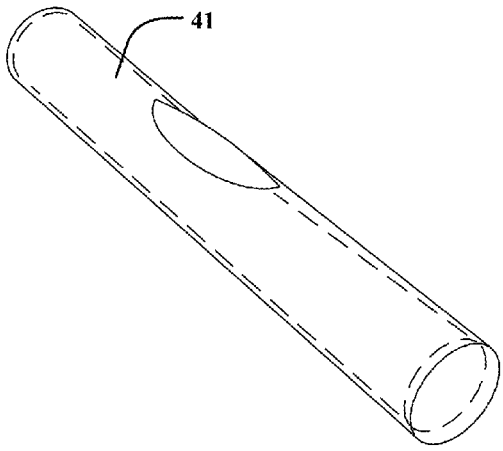
FIG. 14 is a front view of the sleeve.
Figure 15:
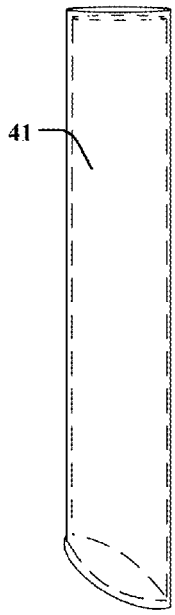
FIG. 15 is a front view of the sleeve.
Figure 16:
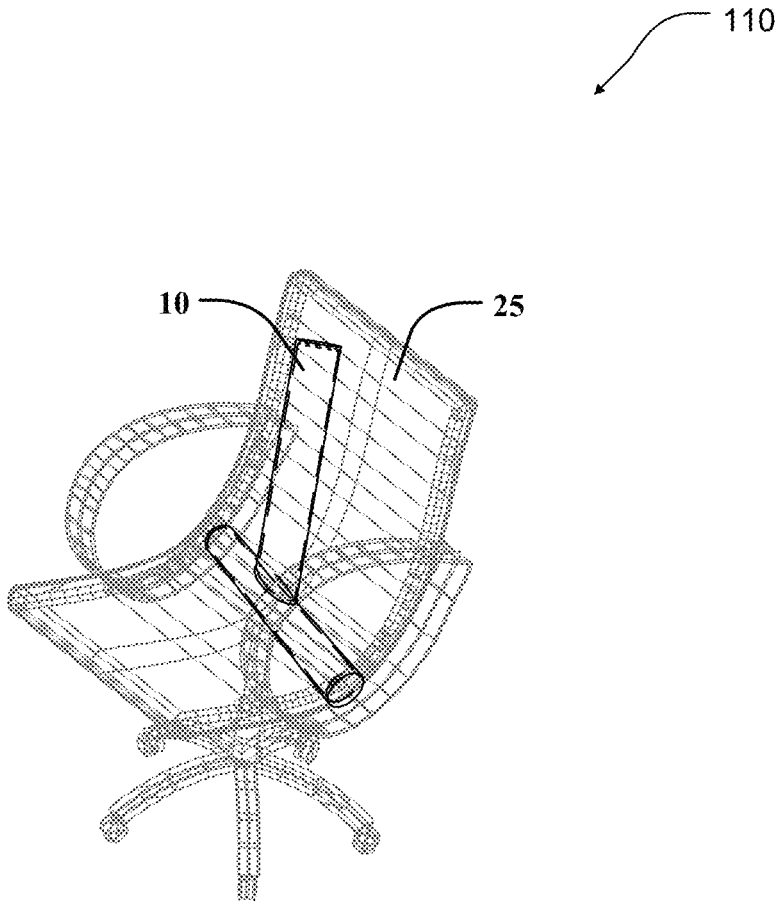
FIG. 16 is a front view of the invention within a chair.
Figure 17:
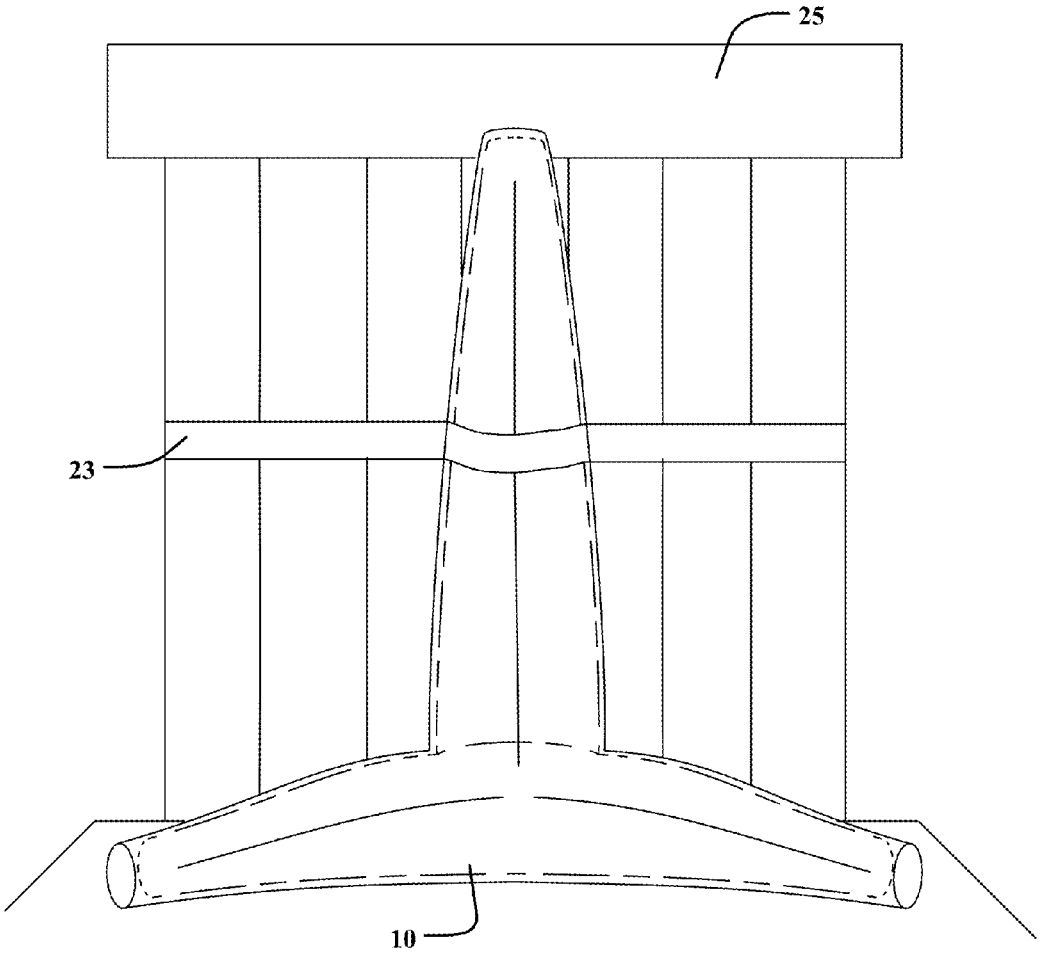
FIG. 17 is a front view of the elongated member received in the grip loop and attached to a chair.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The present invention 10 comprises two elongated members and an attaching strap 23. The first elongated member is defined as a lumbar support member 21, while the second elongated member is defined as a spinal support member 22. The spinal support member 22 is fixedly attached perpendicular to the center 24 of the lumbar support member 21, forming a generally 'T' shape. In an alternative embodiment, the spinal support member 22 is removeably attached to the lumbar support member 21. The attaching strap 23 allows the user the ability to fasten the support members 21, 22 to a chair 25 or seat.

In the preferred embodiment, the lumbar support member 21 comprises a cylindrical shape, having a 4-inch diameter and a length range between 12 and 20 inches. In an alternative embodiment, the lumbar support member 121 comprises a variable graduating diameter with a diameter range of 2 to 6 inches, the variable graduating diameter shaped ergonomically to better support the lumbar portion of the back. In yet a further alternative embodiment, the lumbar support member 221 comprises a crescent shape to better support the back of the user. The shape can go from a smaller diameter to a larger diameter, a larger diameter to a smaller diameter, or can have an oval-shape where the diameter of the ends is smaller than that of the body.

In the preferred embodiment, the spinal support member 22 comprises a cylindrical shape, having a 3-inch diameter and a length range between 16 and 24 inches. In an alternative embodiment, the spinal support member 122 comprises a variable graduating diameter with a diameter range of 2 to 6 inches, the variable graduating diameter shaped ergonomically to better support the spinal section of the back. The shape can go from a smaller diameter to a larger diameter, a larger diameter to a smaller diameter, or can have an oval-shape where the diameter of the ends is smaller than that of the body.

In the preferred embodiment, the lumbar support member 21 and spinal support member 22 are made of inflatable vinyl and further comprise a lumbar air chamber 26 and a spinal air chamber 27, respectively. The air pressure within each individual chamber can be adjusted to suit the user's comfort with inflation members 28 attached to each support member 21, 22. In an alternative embodiment, the lumbar support member 21 and spinal support member 22 are removeably attached, wherein the lumbar support member 21 comprises an aperture, or through-hole, for the spinal support member 22 to slide through. Alternatively, the members 21, 22 can attach using hook-and-loop type fasteners, buttons, straps, zippers, or any other suitable means.

The attaching strap 23 comprises a long, flat, nylon cord 31 having a grip loop 32 in its center and a fastening device 33 at each of its ends 34. In the preferred embodiment, the fastening device 33 comprises a hook-and-loop apparatus on each end 34 of the attaching strap 23. When in use, the grip loop 32 tightly encircles the spinal support member 22 while the attaching strap 23 tightly encircles the user's chair 25 and is held in place by the fastening device 33 on the back side of the chair 25. In an alternative embodiment, the fastening device 33 can attach using buttons, additional straps, zippers, or any other suitable attachment means.

When in use, the spinal support device 10 is placed adjacent to the back rest of any chair 25 or seat, with the lumbar support member 21 at the intersection of the arm rest and the seat and the spinal support member 22 projecting vertically parallel to the back rest. The user will sit onto the chair 25, aligning their lower back with the lumber support member 21 and their spine with the spinal support member 22, which is held in place by the attaching strap 23. When seated, the user's shoulders will inherently move backwards and their posture will instantly become proper. In an alternative embodiment, the spinal support device may be rotated vertically, with the lumbar support member 21 resting on the neck and the spinal support member 22 again aligned with the spine. The spinal support device 10 will be an add-on piece to any existing chair or seat, including, but not limited to, cars, airplanes, trains, busses, offices, homes, couches, etc.

In an alternate embodiment, a decorative sleeve 41 or set of sleeves can be removably attached to cover the elongated members 21, 22. Each sleeve 41 comprises a thin cylindrical tube which tightly encircles each of the elongated members 21, 22. These sleeves 41 allow for a variety of designs, colors, and textures, permitting the user to personalize the appearance of the spinal support device 10 without effecting its utility. In a further alternative embodiment, the lumbar and spinal support members 21, 22 can be extendable to accommodate different sized users and differently shaped chairs/seats.

In a further alternative embodiment, each of the elongated members 321, 322 comprise a inner core 323, 324 encircled by an outer shell 325, 326. The inner core 323 of the lumbar support 321 member comprises a long cylindrical solid, approximately 12-20 inches in length with a radius of 1 inch. The inner core 324 of the spinal support member 322 comprises a length of approximately 16-24 inches and a radius of 1 inch. Each of the inner cores 323, 324 is made of a firm material such as foam, soft plastic or other sturdy but malleable materials. Each outer shell 325, 326 comprises a cylindrical material which spans the entire length of and is fixedly attached to the each inner core 323, 324. The outer shells 325, 326 are made of a soft, yet supportive material, including but not limited to: memory foam, air or liquid filled tubing, etc.

In yet a further alternative embodiment, the spinal support device 110 will be integrated into the chair 125 itself. In such an embodiment, both the elongated members 21, 22 are located within the backing of the chair 25. The two members 21, 22 will still be attached in an upside down 'T' shape which is centered and irremovably fastened to the inner structure of the chair 25 backing No attaching strap or decorative sleeves will be necessary, although the chair itself can be offered in a variety of colors or designs.

While a particular form of the invention has been illustrated and described, it will be apparent that various modifications can be made without departing from the spirit and scope of the invention. For example, while specific sizes and shapes have been properly supported. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A spinal support device comprising:

a first elongated member for spinal support having a generally cylindrical shape, said first elongated member further comprising a variable graduating diameter shaped ergonomically to better support the lumbar portion of the back;

a second elongated member for lumbar support having a generally cylindrical shape, said first elongated member fixedly attached to said second elongated member forming a generally 'T' Shape, said first elongated member longer than said second elongated member;

said first and second elongated members further comprising individual air-filled chambers, wherein said air-filled chambers are adjustable for different body types, deflatable for easy storage, and further comprise inflation valves for inflating and deflating said air-filled chambers; and an attachment strap further comprising a first end, a second end, and a grip loop positioned between said first and second ends, wherein said first and second ends further comprise a hook and loop type fastener and wherein said attachment loop is adapted to receive said first elongated member;

wherein said attachment strap is adapted to removably secure said spinal support device to a chair.

2. The spinal support device of claim 1, wherein said first and second elongated members comprise firm foam.

3. The spinal support device of claim 1, wherein said first and second elongated members comprise soft foam.

4. The spinal support device of claim 1, further comprising an external sleeve.

5. The spinal support device of claim 1, further comprising an inner core and an outer core.

6. A spinal support device comprising:

a chair having a backing;

a first elongated member for spinal support having a generally cylindrical shape, said first elongated member further comprising a variable graduating diameter shaped ergonomically to better support the lumbar portion of the back;

a second elongated member for lumbar support having a generally cylindrical shape, said first elongated member fixedly attached to said second elongated member forming a generally 'T' Shape, said first elongated member longer than said second elongated member;

said first and second elongated members further comprising individual air-filled chambers, wherein said air-filled chambers are adjustable for different body types, deflatable for easy storage, and further comprise inflation valves for inflating and deflating said air-filled chambers; and an attachment strap further comprising a grip loop positioned between said first and second ends, wherein said attachment loop is adapted to receive said first elongated member;

wherein said attachment strap is adapted to fixedly attach said spinal support device to said chair.

7. The spinal support device of claim 6, wherein said first and second elongated members comprise firm foam.

8. The spinal support device of claim 7, wherein said first and second elongated members comprise soft foam.

* * * * *